US005727705A

United States Patent [19]

Kelly

[11] Patent Number: 5,727,705

[45] Date of Patent: Mar. 17, 1998

[54] CLOSURE CAP FOR CLOSURE OF A CONTAINER MOUTH

[75] Inventor: Ronald L. Kelly, Chester, Va.

[73] Assignee: Crown Cork & Seal Technologies Corporation, Alsip, Ill.

[21] Appl. No.: 754,985

[22] Filed: Nov. 22, 1996

[51] Int. Cl.[6] ..... B65D 41/34

[52] U.S. Cl. ..... 215/252; 215/258

[58] Field of Search ..... 215/252, 250, 215/256, 258

[56] References Cited

U.S. PATENT DOCUMENTS

| | | | |
|---|---|---|---|
| 4,978,016 | 12/1990 | Hayes | 215/252 |
| 4,981,230 | 1/1991 | Marshall et al. | 215/252 |
| 5,282,540 | 2/1994 | Beck | 215/252 |
| 5,328,044 | 7/1994 | Rohrs et al. | 215/252 |
| 5,400,913 | 3/1995 | Kelly | 215/252 |
| 5,465,858 | 11/1995 | Gargione | 215/252 |
| 5,570,798 | 11/1996 | Hayashida et al. | 215/252 |

FOREIGN PATENT DOCUMENTS

| | | |
|---|---|---|
| 0 117 104 A2 | 8/1984 | European Pat. Off. . |
| 0 390 412 A1 | 10/1990 | European Pat. Off. . |
| 0 635 434 A1 | 1/1995 | European Pat. Off. . |
| WO 94/14673 | 7/1994 | WIPO . |
| WO 96/24532 | 8/1996 | WIPO . |

*Primary Examiner*—Allan N. Shoap
*Assistant Examiner*—Nathan Newhouse
*Attorney, Agent, or Firm*—Woodcock Washburn Kurtz Mackiewicz & Norris LLP

[57] ABSTRACT

The TE-band (3) of a closure cap for closure of a container is provided with retaining elements (5) which protrude radially inwards and upwards to the base of the closure cap from the inner surface of the TE-bank (3). Each retaining element (5) comprises a retaining surface (6) terminating in a retaining edge (7). The retaining edges engage beneath an engagement surface (10) on the mouth of a container when the closure cap is in position on said container. The retaining edge (7) are formed as a concave segment and all retaining edges (7) together define substantially a circle. The circle is coaxial with the engagement surface of a container mouth and has a diameter which is smaller than the outer diameter of the engagement surface of the container mouth.

6 Claims, 2 Drawing Sheets

CLOSURE CAP FOR CLOSURE OF A CONTAINER MOUTH

BACKGROUND OF THE INVENTION

The invention concerns a closure cap with a tearable Tamper-Evidence band. With such closure caps, the condition of the TE-band permits recognition of prior opening of the container. With the closure cap in position on the container mouth, the TE-bank will engage beneath a retaining surface on the container mouth so that when the container is opened for the first time, the TE-bank will at least partially tear away.

TE-bands are particularly frequently used with screw closures, in particular with screw caps for the closure of beverage containers. However, other types of closure caps, such as snap closures, can also be provided with tearable TE-bands.

For the closure of disposable containers, as a rule closure caps are used with an annular circumferential TE-band that remains on the container neck when the container is opened for the first time. Conversely, the TE-band for the closure of recyclable containers is preferable connected with the cap wall in such a way that, on opening of the container, it will only partially tear and will thus continue to be connected with the cap wall. With this embodiment, a shorter TE-band extending only over a portion of the cap wall circumference is also frequently used.

Certain embodiments of this type of TE-band have a grip to be form away manually prior to opening.

the tearable connection between TE-band and cap wall can be designed in many different ways that are widely documented in the relevant literature. With closure caps that are manufactured in one piece from plastic, the TE-band is particularly frequently connected by tearable connecting bridge pieces with the lower edge of the cap wall.

On the inside surface of the TE-band, retaining elements are arranged which, with the closure cap in position on the container, engage beneath an engagement surface on the container mouth. To this end, retaining elements are frequently used that are rigidly connected with the TE-band. When fitting the closure cap, these engagement elements are pressed radially outwards on being pushed over the bead on the container mouth. Since the engagement elements are rigidly connected with the TE-band, this will simultaneously lead to deformation of the TE-band and thus to a force on the tearable connection between TE-band and cap wall. In the case of screw closures, this force will be additionally increased by torque-forces imparted between the cap wall and the anti-tamper ring, the anti-tamper ring being subjected to braking action by the engagement means making contact with the bead on the container mouth In EP-A2 117 104, the use of radially inwardly protruding flaps on the inside of the TE-band has thus already been suggested as an engagement means, said flaps pointing upwards towards the cap base when the closure cap is in position on the container mouth and engaging beneath the bead on the container mouth. These flaps are connected with the TE-band solely at one end and their free and is able to pivot in the radial direction relative to the TE-band. These flaps can therefore be pivoted outwards in the radial direction when they slide over the bead on the container mouth on initial fitting of the closure cap. The resultant force acting on the tearable connection between TE-band and cap wall will thus be considerable reduced.

A problem with state of the art flaps may be their inadequate resistance to pressure in the longitudinal direction of the flaps. Inadequate firmness may cause the flaps to snap over the retaining bead of the container. This force occurs on opening of the closure cap, or with an attempt to pull the anti-tamper over the bead without tearing it. The state of the art flaps may become bent in the longitudinal direction in this case, leading to a reduced blocking effect being imparted by the flaps. In extreme cases, this can lead to the flaps leaving their locking position against the bead of the container mouth to assume a position pointing downwards, away from the cap base.

It is therefore a purpose of the invention to overcome the disadvantages of the prior art and to further improve the resistance to opening forces of state of the art retaining elements.

SUMMARY OF THE INVENTION

The TE-band of a closure cap for a closure of a container mouth is arranged at the lower edge of the wall of the closure cap. A plurality of retaining elements, each comprising a retaining surface, are arranged on the inside surface of the TE-band to protrude radially inwards and upwards towards the cap base. Each retaining surface terminates in a retaining edge in order to engage beneath a substantially circular engagement surface on the mouth of the container when the closure cap is in position on the container mouth. The resistance to force applied to the retaining elements and contact between the retaining elements and the engagement surface are improved with each retaining edge being formed as a concave segment and with the retaining edges of all retaining elements defining substantially a circle coaxial with the circular engagement surface of the mouth of the container. The diameter of the circle defined by all retaining edges in the closed position of the cap is smaller than the outer diameter of the circular engagement surface. By means of the concave segment the contact surface between the retaining elements of the anti-tamper strip TE-band and the circular engagement surface is increased. By means of the curve of the retaining elements, their resistance will be enhanced and the bending of the retaining elements arising with longitudinal loading will be reduced. As the surface of the curved retaining edge follows substantially the surface of the engagement surface, the line of contact is increased and the pressure per unit area on the retaining edge is decreased.

The retaining elements are preferably designed as flaps which are connected to the bottom of the tamper-indicating band.

the retaining elements can be arranged in different ways along the TE-band. In particular, the distance between the adjacently arranged retaining elements can be selected in different ways. With a preferred embodiment, the retaining elements are arranged tightly adjacently along the TE-band. The lateral edges of the adjacently arranged retaining elements are, with that, connected together by a flexible bridge piece of material in the form of a linkage. In this way, a longitudinal strip comprising a plurality of retaining elements will arise. The retaining elements will thus hold each other mutually in position so that they can no longer be pivoted with such ease. This is advantageous if the closure cap is cast in a form in which the retaining elements are pointed downwards, away from the cap base. This position of the retaining elements is preferred when casting the closure cap, since the cap can be more easily removed form the mold after casting. The retaining elements must, however, subsequently be pivoted from their downward pointing position inwards. This ensues preferable in a separate working step prior to fitting of the closure cap. The retaining elements have, however, the basic tendency to return to their original cast position. One possibility of avoiding this is now to connect adjacently arranged retaining elements together as previously described. The retaining elements will then mutually hold each other at their inner position, directed towards the cap base.

The retaining elements preferably comprise two lateral edges, each flap being connected to the adjacent retaining element by a hinge or a flexible web which improves stability of the retaining element.

The stability of the retaining elements can be further improved if its central portion is thicker than the lateral side area.

Webs or hinges connecting adjacent retaining elements to each other may comprise a nominal rupture line. If someone is attempting to bend back the retaining elements to overcome their tamper-indicating function, the nominal rupture lines will break. Broken nominal rupture lines show that tampering has occurred.

With the closure cap in position on the container mouth, the concave segment of each retaining edge will make contact with the engagement surface of the container substantially over its entire length.

If individual retaining elements are used, arranged at a distance from one another, these can be fixed in another way in their position directed towards the cap base, for example by means of a brief application of heat after the retaining elements have been provided into this position. A possible alternative is to pivot the retaining elements inwards by means of the container mouth directly on fitting of the closure cap on the container mouth.

Preferably, a circumferential anti-tamper ring is used as a TE-band, wherein the retaining elements are arranged to be distributed uniformly around the circumference.

To enhance the flexibility of each individual retaining element, the retaining elements are attached to the bottom of the anti-tamper strip with a flexible hinge. The flexible hinge is preferably fixed on the inner surface of the anti-tamper strip band. The strength of the flexible hinge may more easily be controlled with such a design.

BRIEF DESCRIPTION OF THE DRAWINGS

Examples and embodiments of the invention are more closely described in the following, illustrated by the drawings: namely, FIG. 1 a cross section of a closure cap according to the invention, FIG. 2 a cross section of the TE-band of the closure cap shown in FIG. 1, FIG 3 an enlarged view of three retaining elements from above, FIG. 4 the TE-band of the closure cap shown in FIG. 1 seen from below, FIG. 5 a closure cap in position on a container mouth, FIG. 5*a* a retaining element of a closure cap in position on a container mouth.

DETAILED DESCRIPTION OF THE PREFERRED EMBODIMENTS

Figure 1:
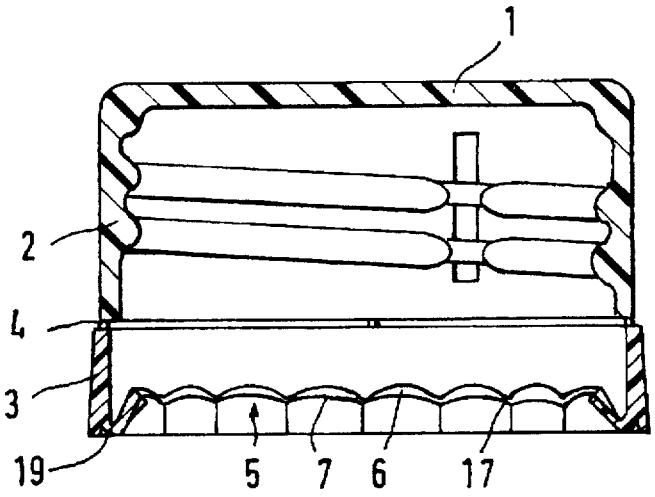

The closure cap shown in FIG. 1 has a cap base 1, an abutting cap wall 2 and a tearable TE-band 3 arranged on the lower edge of said cap wall. The TE-band 3 is integrally connected with the cap wall 2 by means of breakable bridges 4. The TE-band 3 shown in FIG. 1 forms a circumferential anti-tamper ring. From the inside surface of the anti-tamper ring 3, a plurality of retaining elements 5 extend radially inwards. The retaining elements 5 are arranged to be tightly adjacent and are connected together by flexible hinges 17 into a circumferential inner flap strip. For certain applications the TE-band can be used without hinges 17 so that the adjacently arranged retaining elements are independent of one another.

Figure 2:
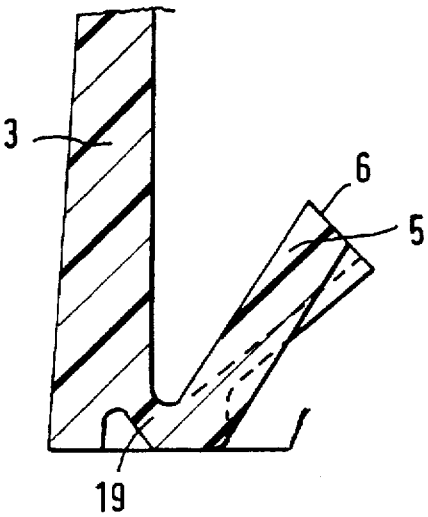

The retaining elements 5 are only connected at one end with the anti-tamper ring 3 by means of a flexible hinge 19 (FIG. 2). This hinge 19 enables the free end of the retaining elements 5 to pivot in the radial direction so that especially on initial application of the closure cap this can deflect radially outwards when said free end slides over the container finish. The hinge 19 is preferably arranged on the lower edge on the inner surface of the anti-tamper ring. It would also basically conceivable, however, for the anti-tamper ring to extend downwards below the connection point of the linkage connection 19.

FIG. 2 shows a cross section of a TE-band 3 to the bottom of which is connected a retaining element 5 by means of a flexible hinge 19. The retaining element 5 comprises a retaining surface 6 directed radially inwards and upwards towards the cap base. The retaining surface terminates in a retaining edge 7 for engagement with an engagement surface of a container. Cross section is made at the centre portion of one of the retaining elements 5.

Figure 3:
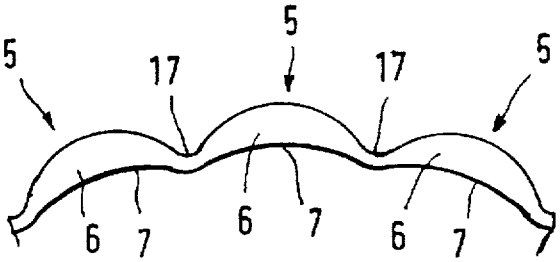

FIG. 3 shows an enlarged view of three retaining elements seen from above. Each retaining element 5 is connected to the adjacent element by flexible hinge 17. Each retaining element 5 comprises a retaining surface 6 directed radially inwards and upwards towards the cap base. The retaining surface 6 terminates in a retaining edge 7 which is formed as a concave segment.

Figure 4:
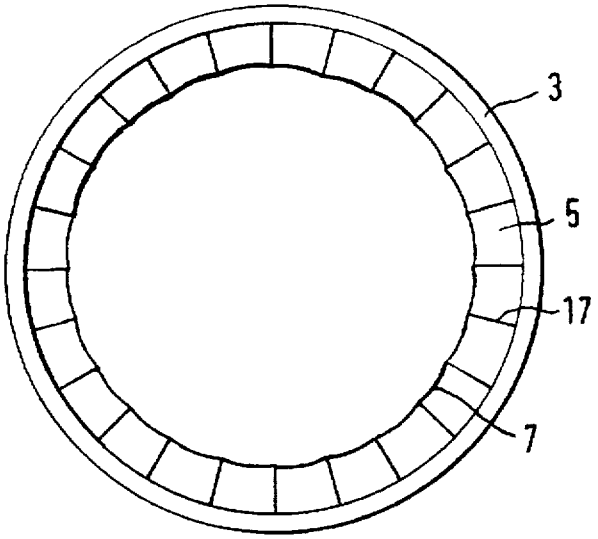

FIG. 4 shows the TE-band 3 seen from below. The retaining elements 5 are disposed regularly on the inner surface of the TE-band 3. Each retaining element is connected to the adjacent retaining elements by a flexible hinge 17. The retaining edge 7 of each retaining element 5 is formed as a concave segment. All the retaining elements form together substantially a circle which is coaxial with the circular engagement surface of a container (see FIG. 5). The diameter of the circle formed by the retaining edge 7 is smaller than the outer diameter of the circular engagement surface.

On applying the closure cap onto the container mouth for the first time, first of all the lateral edge area of the retaining elements will make contact on the bead of the container mouth. If the string motion is continued, the individual retaining elements 5 will pivot about their hinge 19 radially outwards. The circle formed by the retaining edge 7 will have a diameter equal to the outer diameter of the bead of the container mouth or be in contact with the engagement surface 10 of a container.

Figure 5:
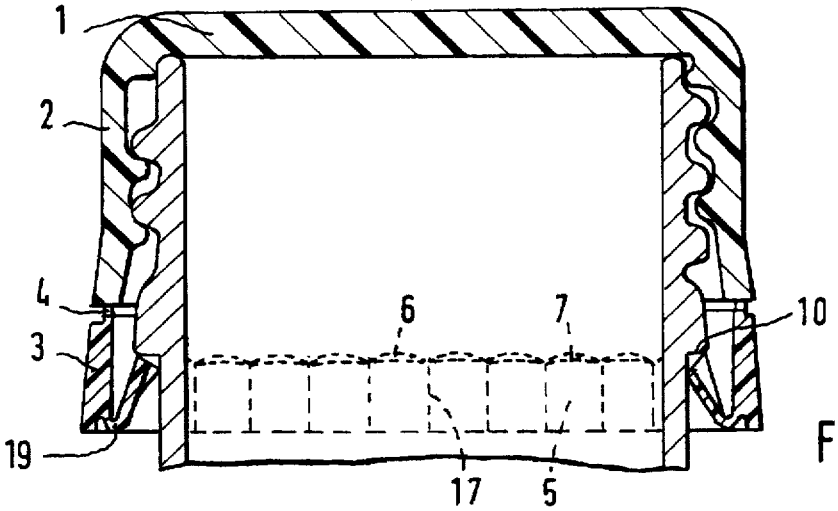
Figure 5A:
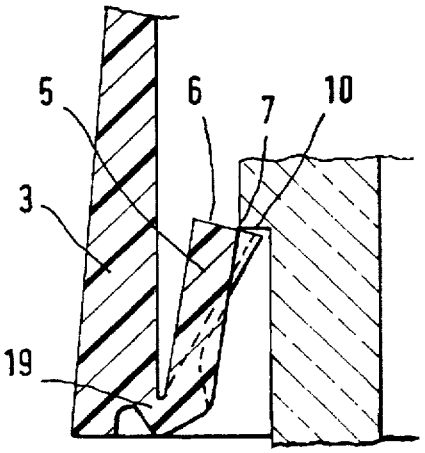

FIG. 5*a* shows a retaining element 5 of a closure cap according to FIG. 5, positioned on the neck of a container. The neck of the container comprises an engagement surface 10 provided on its outer surface. The retaining surface 6 of the retaining element 5 engages the engagement surface 10 of the neck of the container. Especially the shape of retaining edges 7 corresponds to the shape of the engagement surface.

Inasmuch as the invention is subject to modifications and variations, the foregoing description and accompanying drawings should not be regarded as limiting the invention, which is defined by the following claims and various combinations thereof:

What is claimed is:

1. Closure cap for closure of a container mouth, said closure cap comprising a cap base (1), an abutting cap wall (2) and a tamper-evidence band (3) being arranged on the lower edge of said cap wall, and a plurality of retaining elements (5) each comprising a retaining surface (6), being arranged on the inside surface of the tamper-evidence band (3) to protrude radially inwards and upwards towards the cap base (1), each retaining surface (6) terminating in a retaining edge (7) in order to engage beneath a substantially circular engagement surface (10) on the container mouth when the closure cap is in position on the container mouth, characterized in that each retaining edge (7) is formed as a concave segment and all retaining edges (7) define substantially a circle which is coaxial with the circular engagement surface (10) and which has a diameter smaller than the outer diameter of the circular engagement surface (10) of the container mouth.

2. Closure cap according to claim 1, characterized in that the retaining elements (5) are formed as flaps.

3. Closure cap according to claim 2, characterized in that each flap comprises two lateral edges, whereby each flap is connected to the adjacent flaps at its lateral edges by a flexible hinge (17).

4. Closure cap according to claim 3, characterized in that the flap centers are thicker than the lateral edge areas of the flaps.

5. Closure cap according to claim 3, characterized in that the connecting hinge (17) comprises a nominal rupture line.

6. Closure cap according to claim 1, characterized in that each retaining element (5) is attached to the bottom of the tamper-evidence band (3) with a flexible hinge (19) protruding from the inner surface of the tamper-evidence band (3).

* * * * *

UNITED STATES PATENT AND TRADEMARK OFFICE

CERTIFICATE OF CORRECTION

PATENT NO. : 5,727,705

DATED : March 17, 1998

INVENTOR(S) : Ronald L. Kelly

It is certified that error appears in the above-identified patent and that said Letters Patent is hereby corrected as shown below:

TITLE PAGE:

Column 2, Abstract, line 5, delete "TE-bank" and insert --TE-band-- therefor.

Column 1, line 9, delete "TE-bank" and insert --TE-band-- therefor.
Column 1, line 11, delete "TE-bank" and insert --TE-band-- therefor.
Column 1, line 22, delete "preferable" and insert --preferably-- therefor.
Column 1, line 31, delete "the tearable" and insert --The tearable-- therefor.
Column 1, line 59, delete "free and" and insert --free end-- therefor.
Column 1, line 65, delete "considerable" and insert --considerably-- therefor.

Column 2, line 3, delete "an attempt" and insert --any attempt-- therefor.
Column 2, line 48, delete "the retaining" and insert --The retaining-- therefor.
Column 2, line 63, delete "removed form" and insert --removed from-- therefor.
Column 2, line 66, delete "preferable" and insert --preferably -- therefor.

Column 3, line 29, delete "been provided into" and insert --been pivoted into-- therefor.

UNITED STATES PATENT AND TRADEMARK OFFICE

CERTIFICATE OF CORRECTION

PATENT NO. : 5,727,705

DATED : March 17, 1998

INVENTOR(S) : Ronald L. Kelly

It is certified that error appears in the above-identified patent and that said Letters Patent is hereby corrected as shown below:

Column 4, line 17, delete "would also" and insert --would be also-- therefor.

Signed and Sealed this

Ninth Day of June, 1998

*Attest:*

Bruce Lehman

BRUCE LEHMAN

*Attesting Officer*

*Commissioner of Patents and Trademarks*